US009180953B1

(12) United States Patent
Durand

(10) Patent No.: US 9,180,953 B1
(45) Date of Patent: Nov. 10, 2015

(54) AIRBOAT BRAKING SYSTEM

(71) Applicant: Roger Durand, Marianna, FL (US)

(72) Inventor: Roger Durand, Marianna, FL (US)

( * ) Notice: Subject to any disclaimer, the term of this patent is extended or adjusted under 35 U.S.C. 154(b) by 57 days.

(21) Appl. No.: 14/264,597

(22) Filed: Apr. 29, 2014

(51) Int. Cl.
*B63H 25/48* (2006.01)
*B63H 7/00* (2006.01)
*B63H 25/44* (2006.01)

(52) U.S. Cl.
CPC ..... *B63H 25/44* (2013.01)

(58) Field of Classification Search
CPC ..... B63H 7/00; B63H 7/02; B63H 25/44
USPC ..... 440/37; 114/145 R
See application file for complete search history.

(56) References Cited

U.S. PATENT DOCUMENTS 3,191,571 A * 6/1965 Rex ..... B60F 3/0076 440/12.5
3,259,097 A * 7/1966 Van Veldhuizen ..... B60V 1/14 114/67 A
4,421,489 A * 12/1983 Van Veldhuizen ..... B60V 1/14 114/150
4,932,839 A * 6/1990 Pitchford ..... B63H 7/02 416/246
5,082,465 A * 1/1992 Wine ..... B63H 7/02 416/189
5,769,021 A * 6/1998 Schad ..... B60F 3/003 114/43
6,581,536 B1 * 6/2003 Belloso ..... B60V 1/08 114/274
7,007,621 B1 3/2006 Bootes
8,316,787 B2 11/2012 Back
8,562,284 B2 10/2013 Bradbrook
2012/0292886 A1 11/2012 Friberg
2013/0253795 A1 9/2013 Brueggemann et al.

* cited by examiner

*Primary Examiner* — Daniel V Venne
(74) *Attorney, Agent, or Firm* — Lawrence J. Gibney, Jr.

(57) ABSTRACT

One of the challenges in the operation of an airboat is to insure that the boat can be stopped quickly and safely and can turn left or right as needed. This is compounded by the fact that airboats typically move on the top surface of the water and there is very little boat surface below the surface of the water. With this system a pair of brake plates are positioned on the stern of the airboat and can be rotated in a downward fashion to strike the water surface in order to stop or turn the airboat in a safe, controlled fashion.

6 Claims, 5 Drawing Sheets

AIRBOAT BRAKING SYSTEM

BACKGROUND OF THE INVENTION

A. Field of the Invention

This relates to the ability of an ability to brake an airboat. Airboats have unique challenges because there is no propeller in the water and all braking is done either by slowing the boat down or by essentially stopping the engine. However, this may leave the person at risk for being able to maneuver the vessel if there are rough seas.

B. Prior Art

This is a device that will be used to help control the forward movement of an airboat. Airboats, unlike a typical boat rests on the top surface of the water and has very little draft or depth below the surface of the water. This type of boat is ideal for use in shallow water that can be found in swamps.

However, because the water is shallow it is very difficult to stop the boat in the event of an emergency.

There are prior art references that deal with systems for airboats and these can be found at Bootes, U.S. Pat. No. 7,007,621 and Schad, U.S. Pat. No. 5,769,021.

The Bootes '621 reference uses a set of plates that are mounted on the back or stern of a standard boat and will strike the water when the device is actuated.

The Schad '021 reference is an amphibious craft that employs an airboat cage but is not specifically a device to brake an airboat.

BRIEF SUMMARY OF THE INVENTION

A typical airboat rests on the top surface of the water. The airboat's propulsion is generated by a rather large fan at the end of the airboat pushing wind through the fan and thereby creating movement forward. The airboat is typically used in areas that have shallow water or areas with an extreme amount of trash that could otherwise foul a propeller of a standard boat.

One of the challenges is being able to safely stop an airboat and perhaps steer the boat. This device will be installed as a brake system that is often referred to as a canebrake.

If an individual does not necessarily know how to operate an airboat, it may create a situation where the operator endangers the people on the airboat by moving too fast through the water or perhaps not be able to control the boat.

This device will be set on the stern of the boat. It will be comprised of a set of twin plates which are mounted such that, when the device is actuated, the plates will strike the water and slow the boat down by producing increased drag on the airboat or turn left or right or used as a trim tab.

The device itself will be mechanically linked so that each plate can operate independently of each other. The control arm for the operation of the braking system will be spring loaded so that the plates would ordinarily be in a position above the water so it does not create any undue stress on the boat.

A separate handle that will be located near the seat of the operator will control the operation of the device and the plates. The handle can be pulled straight up or can be moved from side to side to effect the movement of the plates that are mounted on the stern of the vessel. If the handle is moved from side to side, depending on the specific movement the plate(s) will strike the water surface unequally and allow the boat to be steered. The device is not intended to primarily steer the airboat but some steering may be desired in the appropriate circumstance.

NUMBERING DESCRIPTION

Figure 1:
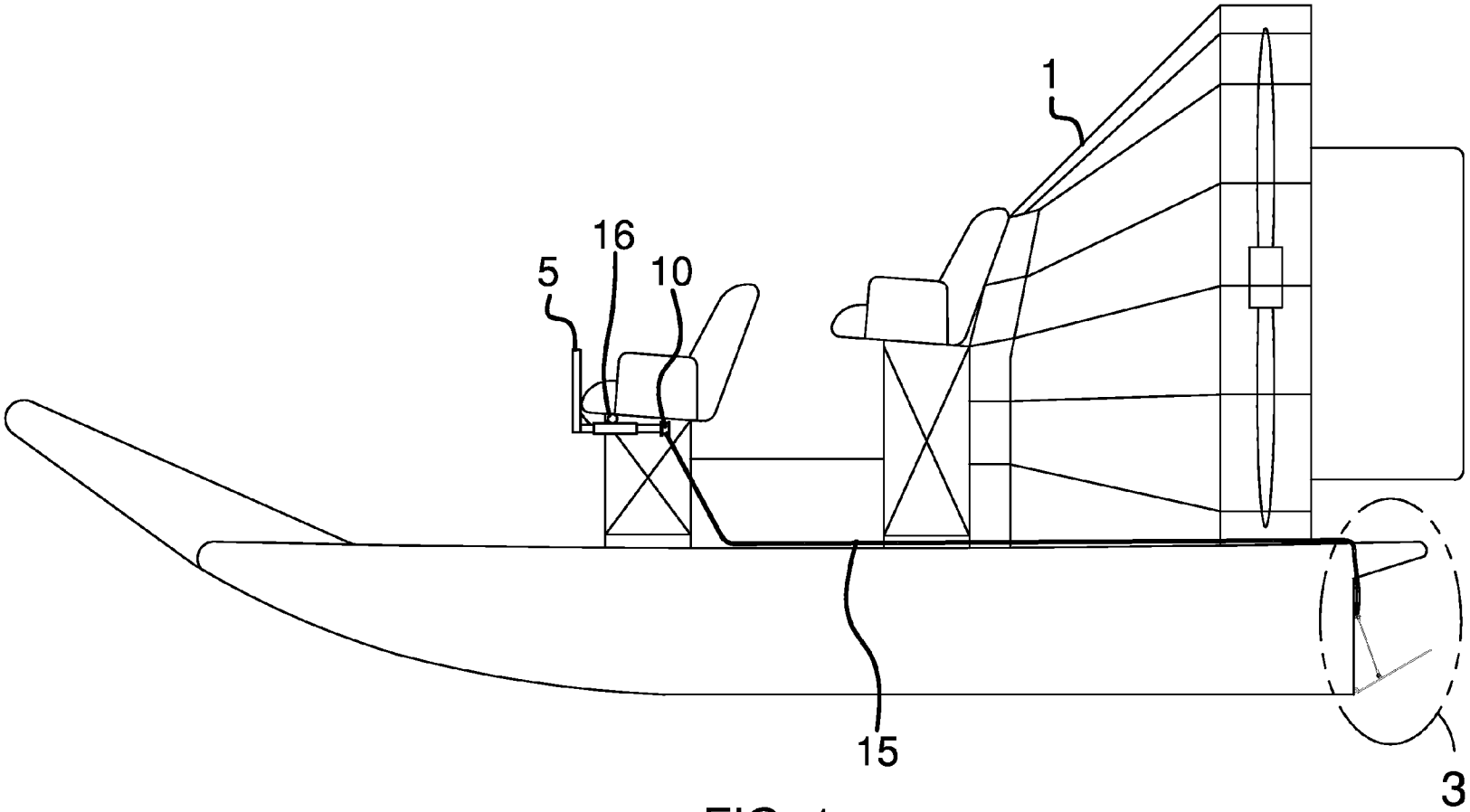
FIG. 1 is a front view of an airboat and the device installed on the airboat.

1 Air Boat
5 Control Arm
10 Canebrake
15 First Linkage Cable
16 Mounting Piece
17 Interior Tube
20 Linkage Coupling
25 Second Linkage Cable
30 Actuator
35 Brake Plate
40 Back of air boat
45 Ball Joints
46 Brake Plate Rod
47 Brake Plate Stern Plate
50 Removable hinge

DETAILED DESCRIPTION OF THE EMBODIMENTS

First Embodiment

This is a device that will be installed on the stern of an air boat 1 and which is operated by a control arm 5 by the operator of the airboat.

The control arm 5 is linked to an interior tube 17 that rotates freely within an outer tube 19; the interior tube 17 extends a predetermined distance and secures a bracket 18. On the ends of the bracket 18 will be means to attach a pair of first linkage cables. The control arm 5 can be moved up or down or side to side.

Figure 5:
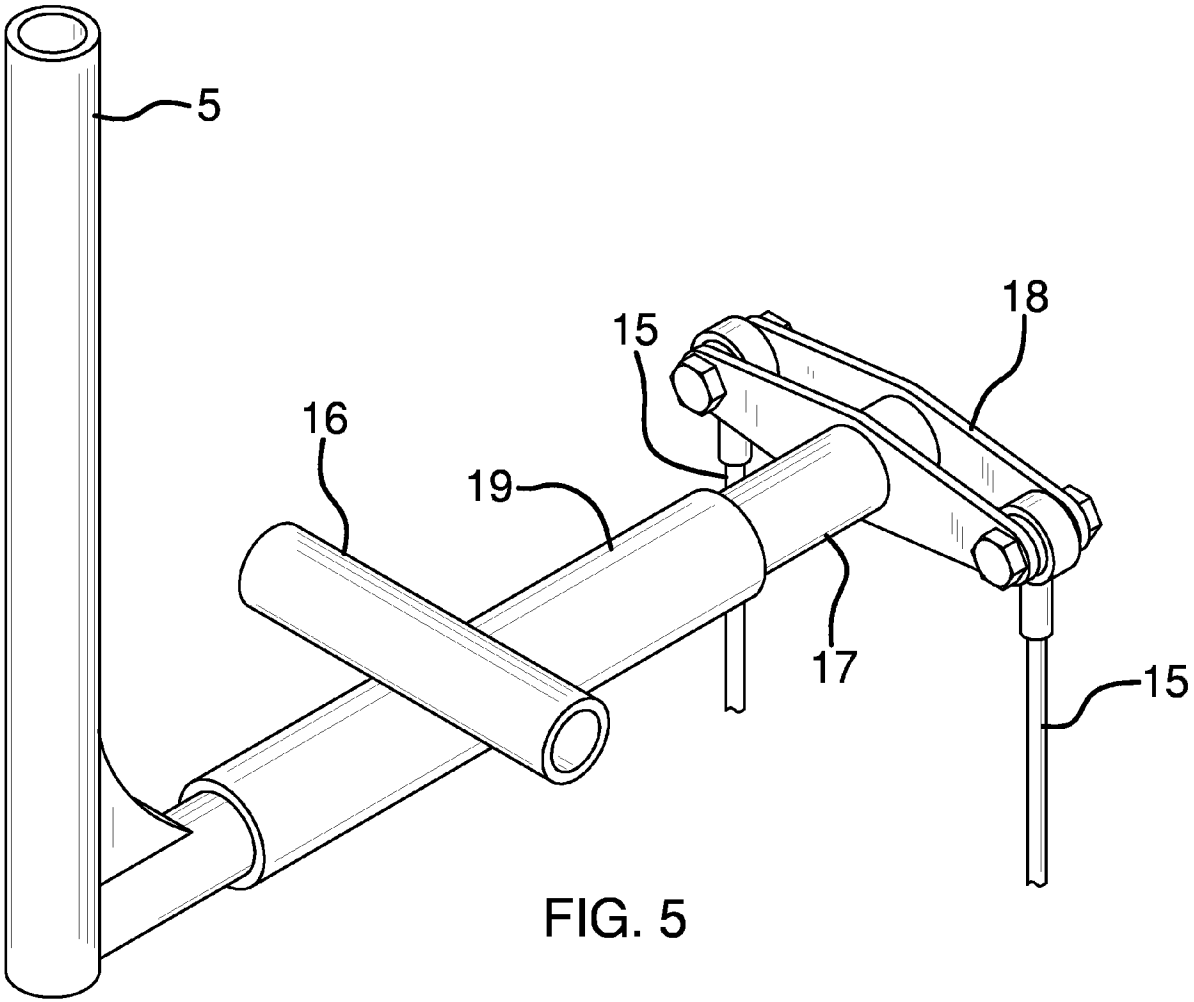
FIG. 5 is a view of the mechanical linkage of the canebrake.

A mounting piece 16 secures the brake to the underside of the seat of the airboat. The mounting piece 16 is secured to the outer tube 19 that houses the interior tube 17 such as depicted in FIG. 5.

If the control arm 5 is moved directly up or down the brake plates through appropriate linkage will deploy and strike the water at the same time. If the control arm 5 is rotated from side to side the interior tube 17 will rotate the bracket and in turn will move either the cable on the right or on the left either up or down. This allows the "steering" function of this device.

The canebrake 10 is linked by a set of first linkage cables 15 that extend from the control handle 5 to the stern of the boat to a linkage coupling 20. The linkage coupling 20 is secured probably by a rivet or plurality of rivets to the stern 40 of the boat.

As the first linkage cables 15 travels from the seat for the operator the cables will crisscross in the back through the linkage coupling 20 and be secured to a pair of actuators that are secured to the stern of the vessel.

The cables are crisscrossed to prevent injury to the cables from foreign objects in the environment.

Figure 2:
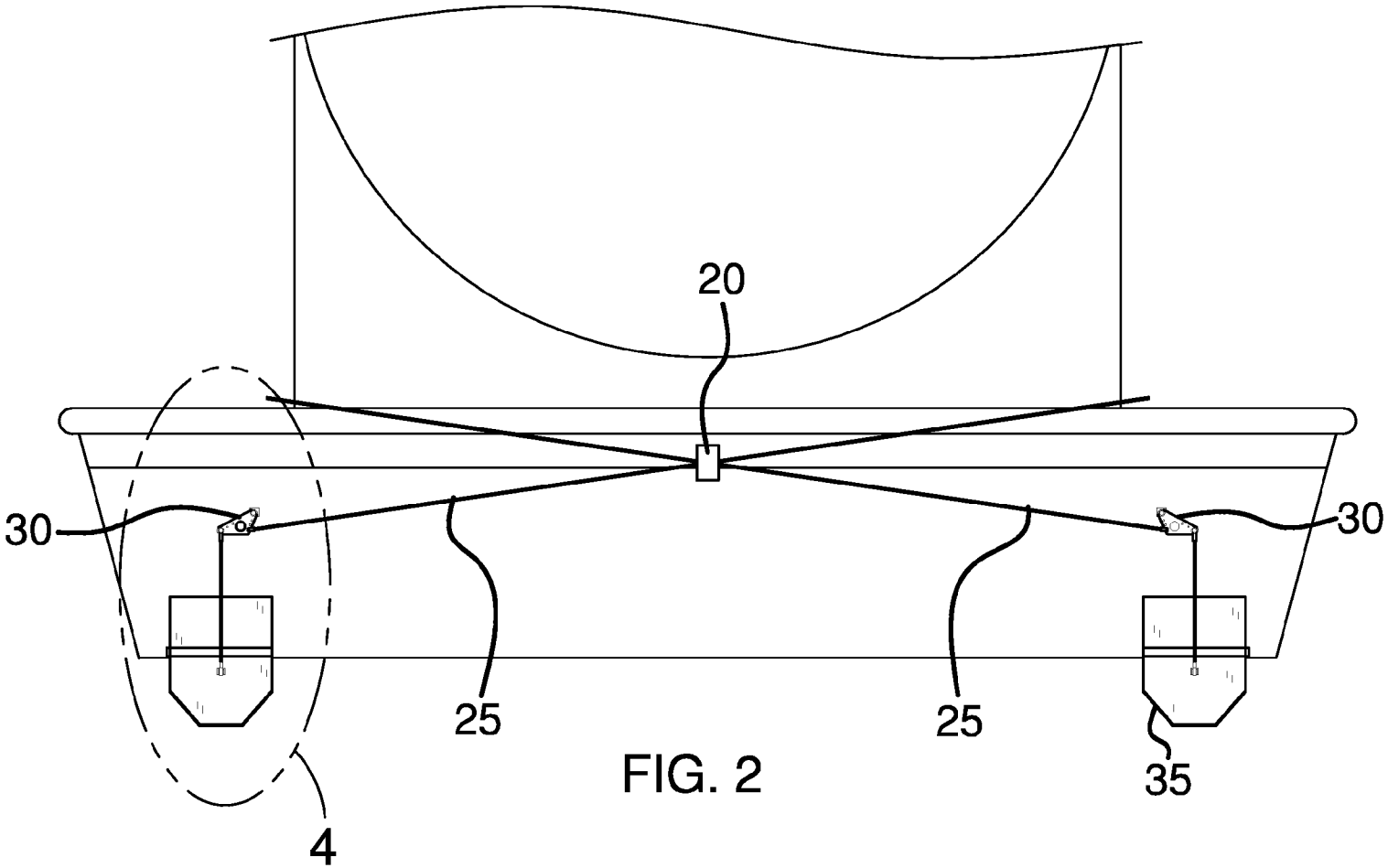
FIG. 2 is view from the stern of the airboat depicting the linkage and the brake plates.
Figure 3:
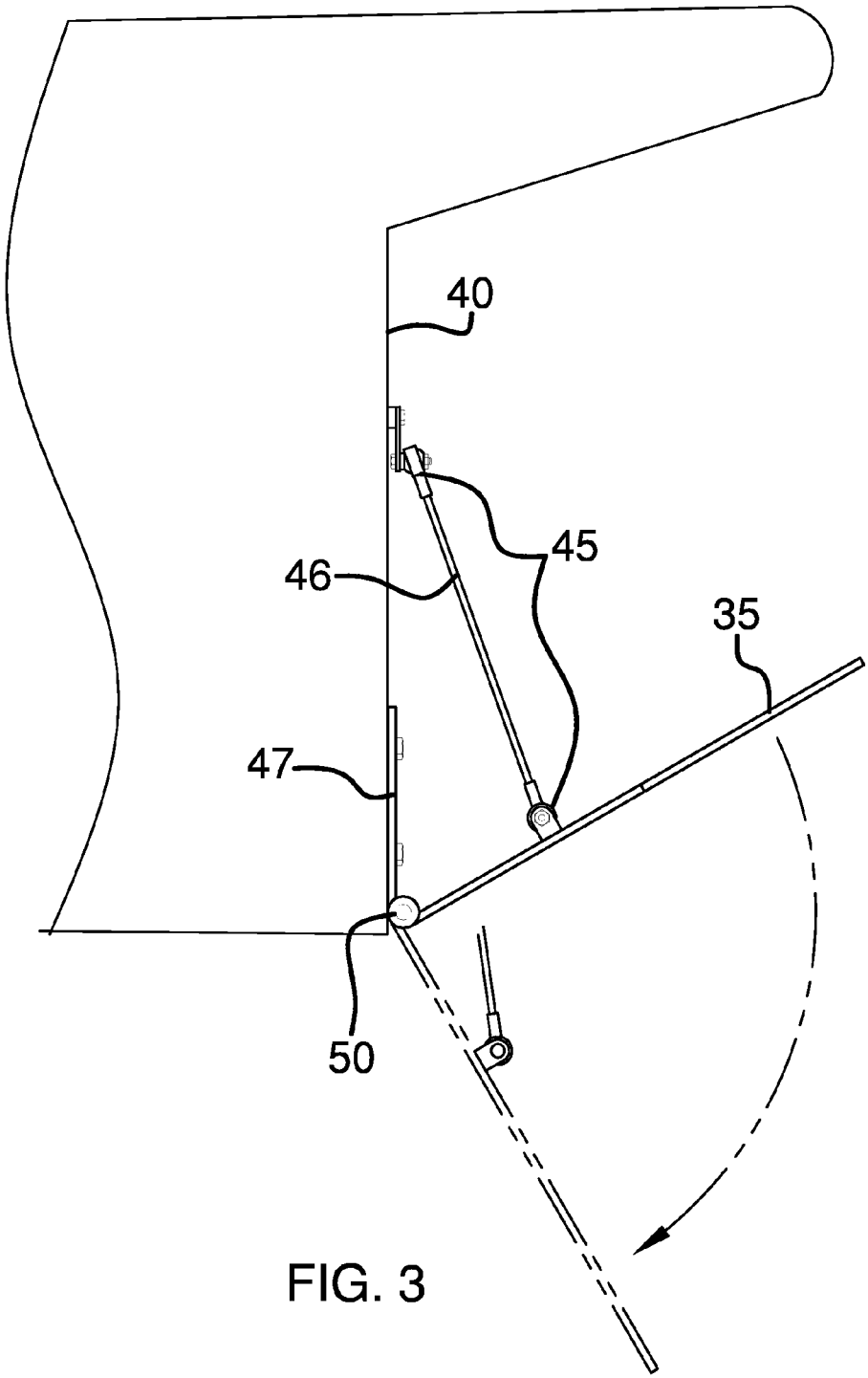
FIG. 3 is a side view of the airboat braking system on the stern of the airboat.
Figure 4:
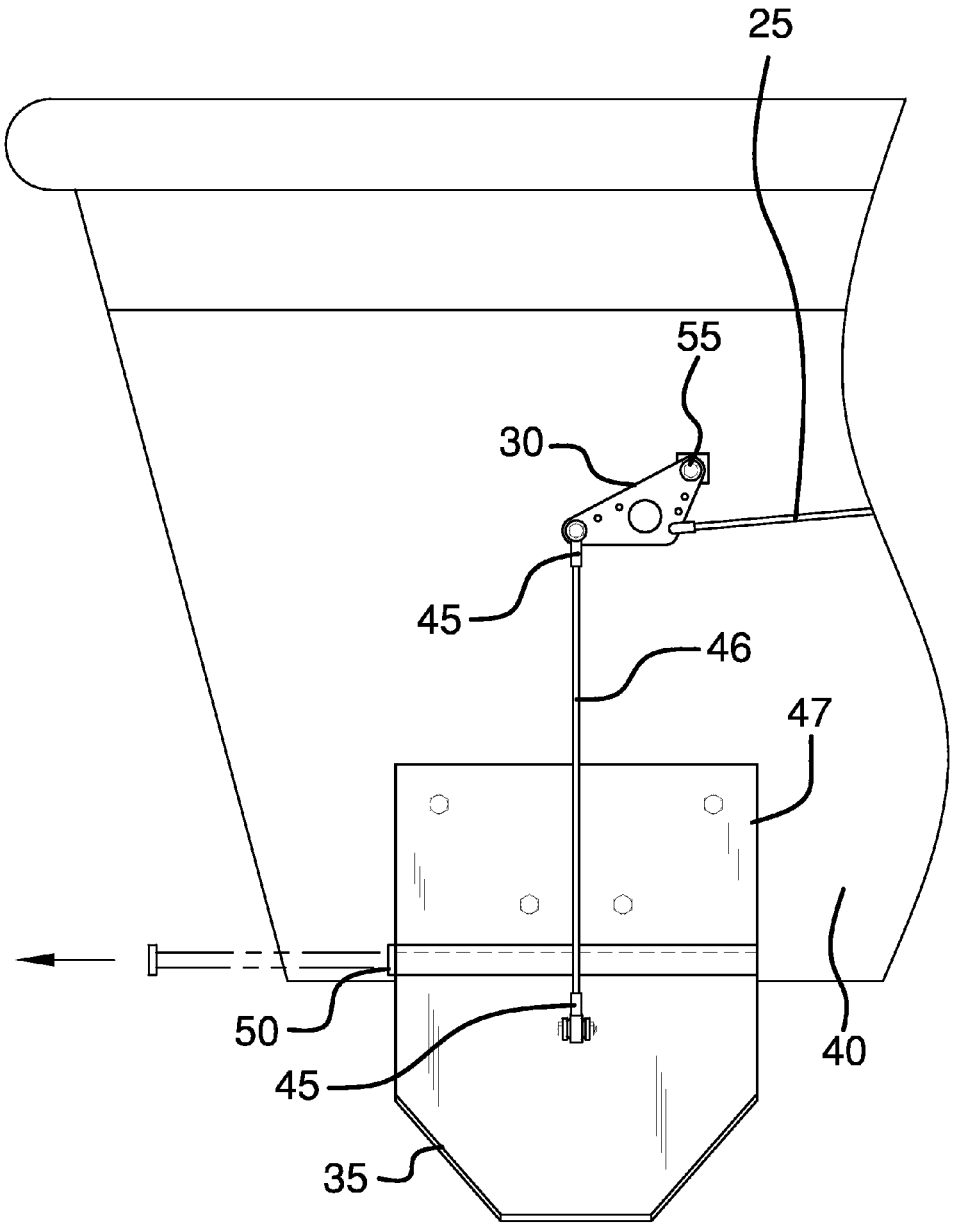
FIG. 4 is a front view of the brake system as it is installed on the stern of the boat.

The linkage coupling 20 protects the pair of cables that extend from the linkage coupling 20 to the actuator arms 30 which are part of the canebrake 10 on either side of the stern such as depicted in FIG. 2. The actuator arms in turn secure a pair of brake plates 35 that rotate downward when the control arm is pulled in a backward motion.

When the control arm 5 is moved either to the left or right the brake plate on the right or on the left will be affected and strike the water unevenly thereby allowing some "steering" capability.

When the control arm 5 is not being touched the brake plates 35 will remain above the surface of the water so that drag is not created during normal operation of the airboat. A pair of ball joints and brake plate rod 46 between ball joints 45 will provide the needed mechanical linkage connects the actuator arm to the brake plate 35. The length of the brake plate rod 46 is adjustable.

The brake plate 35 is connected to the brake plate stern plate 47.

Although this device is contemplated to be used on an airboat it may also be used on airboats on ice. A removable hinge pin 50 will allow a portion of the brake plate to be removed and replaced if damaged with another plate.

The control arm 5 will be spring loaded so that the brake plates 35 are in the up position and not touching the water during normal operation of the airboat.

In normal operation, the operator of the air boat 1 will pull the control arm 5 which will engage the cables and the plates to use both at the same time to stop or left or right to turn the boat and such that the brake plates 35 will rotate down and strike the water.

If the brake plate should become damaged a removable hinge pin 50 will permit the brake plate to be removed and replaced. A brake plate stern plate 47 that secures the brake plate 35 is secured to the stern of the vessel and the use of the hinge pin will eliminate the need to remove both the brake plate and the plate that has been secured to the stern. The means to secure the brake plate stern plate is likely to be rivets but may also be screws.

Second Embodiment

In an ice environment the brake plate 35 will have a series of spikes on the surface to strike the ice when the brake plate is positioned such that it will grip the ice in order to stop the boat or make the boat turn left or right.

While the embodiments of the invention have been disclosed, certain modifications may be made by those skilled in the art to modify the invention without departing from the spirit of the invention.

The invention claimed is:

1. An airboat brake system, which is comprised of:

a. a control arm;
  wherein the control arm is spring loaded;
  wherein the control arm provides a control handle;

b. an interior tube;
  wherein the interior tube has a first end and a second end;
  wherein the interior tube is secured at the first end to the control arm;
  wherein the interior tube secures a bracket at the second end;

c. a mounting piece;
  wherein the mounting piece secures the control arm to the underside of a seat for an operator;

d. a pair of cables;
  wherein the pair of cables has a first end and a second end;
  wherein the first end of the pair of cables is secured to a bracket at the second end of the interior tube;

e. a linkage coupling;
  wherein the linkage coupling is mounted to the airboat;
  wherein the pair of cables passes through the linkage coupling;
  said pair of cables are crisscrossed f. a pair of actuators;
  wherein the second end of the pair of cables are connected to the pair of actuators;
  wherein the pair of actuators provide linkage between the pair of cables and a brake plate;

g. a pair of brake plates;
  wherein a pair of brake plates are provided;
  said pair of brake plates are of a predetermined shape;

h. a pair of brake plate stern plates;
  wherein said pair of brake plate stern plates are secured to the airboat;

i. a pair of brake plate rods;
  wherein the pair of brake plate rod secures the pair of brake plate stern plates to the pair of actuators;

j. a removable hinge pin;
  wherein the removable hinge pins are provided as a link between the brake plate stern plate and the brake plate.

2. The device as described in claim 1 wherein the brake plate stern plate is mounted using rivets.

3. The device as described in claim 1 wherein the brake plate stern plate is mounted using screws.

4. The device as described in claim 1 wherein the cables are crisscrossed to prevent damage from foreign elements.

5. The device as described in claim 1 wherein the length of the brake plate rod is adjustable.

6. The device as described in claim 1 wherein the brake plates are equipped with spikes.

* * * * *